US009455514B2

(12) United States Patent
Hirakawa et al.

(10) Patent No.: US 9,455,514 B2
(45) Date of Patent: Sep. 27, 2016

(54) FEMALE TERMINAL HAVING AN ELASTIC CONTACT MEMBER WITH A PLURALITY OF CURVED CONTACT PORTIONS

(71) Applicant: Yazaki Corporation, Tokyo (JP)

(72) Inventors: Takayoshi Hirakawa, Kakegawa (JP); Toshikazu Yoshioka, Kakegawa (JP); Atsunori Iwashita, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/926,676

(22) Filed: Oct. 29, 2015

(65) Prior Publication Data

US 2016/0126651 A1 May 5, 2016

(30) Foreign Application Priority Data

Oct. 31, 2014 (JP) ..... 2014-223832

(51) Int. Cl.

| | |
|---|---|
| ***H01R 13/187*** | (2006.01) |
| ***H01R 13/02*** | (2006.01) |
| ***H01R 13/193*** | (2006.01) |
| *H01R 4/18* | (2006.01) |
| *H01R 13/11* | (2006.01) |

(52) U.S. Cl.

CPC ..... *H01R 13/02* (2013.01); *H01R 13/187* (2013.01); *H01R 13/193* (2013.01); *H01R 4/188* (2013.01); *H01R 13/111* (2013.01)

(58) Field of Classification Search

CPC ..... H01R 4/20; H01R 4/185; H01R 4/188; H01R 13/02; H01R 13/111; H01R 13/193

USPC ..... 439/441, 843, 877, 884, 889

See application file for complete search history.

(56) References Cited

U.S. PATENT DOCUMENTS

| | | | | |
|---|---|---|---|---|
| 6,254,439 | B1 | 7/2001 | Endo et al. | |
| 6,848,922 | B2 * | 2/2005 | Coughlan | H01R 13/53 439/181 |
| 6,899,571 | B1 | 5/2005 | Koch et al. | |
| 8,678,867 | B2 * | 3/2014 | Glick | H01R 13/187 439/843 |

(Continued)

FOREIGN PATENT DOCUMENTS

| | | | |
|---|---|---|---|
| DE | 19836196 | A1 | 2/1999 |
| DE | 102012001560 | A1 | 8/2013 |

(Continued)

OTHER PUBLICATIONS

Office Action issued on Jul. 7, 2016, by the German Patent Office in counterpart German Application No. 102015221287.4.

*Primary Examiner* — Chandrika Prasad

(74) *Attorney, Agent, or Firm* — Sughrue Mion, PLLC

(57) ABSTRACT

A female terminal includes a conductive terminal body having a cylindrical portion to which a mating male terminal is to be inserted, and a cylindrical elastic contact member configured to apply a contact pressure to the male terminal when the male terminal is inserted into the terminal body. The elastic contact member comprises a plurality of contact portions which are partitioned by slits extending in an axial direction of the cylindrical portion and the plurality of contact portions are curved toward inside the cylindrical portion. A front end portion of the elastic contact member, to which the male terminal is to be inserted, is connected to the cylindrical portion while a rear end portion of the elastic contact member is made a free end.

5 Claims, 6 Drawing Sheets

(56) References Cited

U.S. PATENT DOCUMENTS 8,784,143 B2 * 7/2014 Edgell ..... A61N 1/3752 439/246
8,808,039 B2 * 8/2014 Mott ..... H01R 13/629 439/843
8,840,439 B1 * 9/2014 Wiatrowski ..... B63H 20/10 440/61 T
8,858,264 B2 * 10/2014 Mott ..... H01R 4/28 439/660
8,876,562 B2 * 11/2014 Glick ..... H01R 13/187 439/843
2003/0068931 A1 4/2003 Swearingen et al.
2016/0134044 A1 5/2016 Hirakawa et al.

FOREIGN PATENT DOCUMENTS

DE 112014003160 T5 3/2016
JP 2000-91013 A 3/2000

* cited by examiner

11

FEMALE TERMINAL HAVING AN ELASTIC CONTACT MEMBER WITH A PLURALITY OF CURVED CONTACT PORTIONS

CROSS REFERENCE TO RELATED APPLICATIONS

This application is based on Japanese Patent Application (No. P2014-223832) filed on Oct. 31, 2014, the contents of which are incorporated herein by reference.

BACKGROUND OF THE INVENTION

1. Field of the Invention

The present disclosure relates to a female terminal.

2. Description of the Related Art

In the related art, a plurality of pieces of electric apparatus are mounted on a car such as an electric car or a hybrid car. A plurality of large current electric wires are connected to such electric apparatus through connectors. Such a connector has a configuration in which rod-like male terminals and female terminals into which the male terminals are inserted are received in housing portions respectively. As such a female terminal, there has been known a female terminal including a cylindrical terminal body to which a male terminal is inserted, and a cylindrical elastic contact member that is received in the terminal body so as to apply a contact pressure to the male terminal (see JP-A-2000-91013).

The elastic contact member is formed so that a plurality of contact portions partitioned by slits extending in the insertion direction of the male terminal can be curved inward (toward the male terminal). Axial movement of the elastic contact member is restricted by a stopper formed in the terminal body. An insertion opening of the terminal body is capped with an annular cap so that the elastic contact member inserted into the terminal body can be retained between the inner circumferential surface of the cap and the stopper.

Since the elastic contact member configured thus is retained between the cap and the stopper, the contact portions are elastically deformed radially to generate a contact pressure with respect to a male terminal when the male terminal is inserted. However, the contact portions cannot be deformed to extend in an axial direction of the elastic contact member. Therefore, for example, there arises a problem that an insertion load increases when a large-diameter male terminal for a large current is inserted into the elastic contact member.

SUMMARY OF THE INVENTION

The present disclosure has been developed in consideration of the foregoing problem. An object of the disclosure is to reduce an insertion load of a male terminal.

In order to solve the foregoing problem, female terminal comprising:

a conductive terminal body comprising a cylindrical portion to which a male terminal is to be inserted; and a cylindrical elastic contact member configured to apply a contact pressure to the male terminal which is inserted into the conductive terminal body;

wherein the elastic contact member comprises a plurality of contact portions which are partitioned by slits extending in an insertion direction of the male terminal and the plurality of contact portions are curved toward the male terminal; and wherein a front end portion of the elastic contact member, to which the male terminal is to be inserted, is connected to the conductive terminal body while a rear end portion of the elastic contact member is made a free end.

In this manner, since the rear end portion of the elastic contact member functions as a free end, the contact portions pressed onto the male terminal are elastically deformed in such a direction that curved parts of the contact portions can expand, while the contact portions are also deformed to extend in the axial direction of the cylindrical portion (in the insertion direction of the male terminal). That is, elastic deformation of the elastic contact member can be increased. As a result, the male terminal can elastically deform the contact portions with a reduced force, so that the insertion load of the male terminal can be reduced.

In addition, since the front end portion of the elastic contact member is connected to the terminal body, reliability in conduction between the elastic contact member and the terminal body is improved.

In this case, for example, the front end portion of the elastic contact member is fixed to the cylindrical portion.

In this case, for example, a plurality of protrusion pieces are protruded radially from the front end portion of the elastic contact member, and the protrusion pieces are connected to a front end surface of the conductive terminal body respectively. According to this configuration, in the elastic contact member, connection portions with the terminal body can be formed in a direction intersecting (for example, perpendicularly) the insertion direction of the male terminal. Thus, the holding force of the elastic contact member can be enhanced.

In this case, for example, the plurality of protrusion pieces are fixed to the front end surface of the cylindrical portion respectively.

In addition, for example, a plurality of groove portions to which the plurality of protrusion pieces are connected are formed in the front end surface of the conductive terminal body. According to this configuration, the elastic contact member can be positioned relatively to the cylindrical portion when the protrusion pieces are located in the groove portions respectively. It is therefore easy to perform the work of connecting the elastic contact member. In addition, when the groove portions are formed so that the groove portions can receive the protrusion pieces, the connection portions of the protrusion pieces can be protected from external impact or the like.

According to the disclosure, it is possible to reduce an insertion load of a male terminal.

DETAILED DESCRIPTION OF THE EXEMPLARY EMBODIMENTS

An embodiment of a female terminal to which the invention is applied will be described below with reference to the drawings. The female terminal according to the embodiment is used in a connector for connecting large-current electric wires respectively connected to two pieces of electric apparatus mounted in an electric car, a hybrid car or the like. The female terminal is designed to be connected to terminals of the electric wires and retained in a not-shown resin housing or the like. However, the female terminal according to the invention is not limited to one in this embodiment, but it may be applied to various connectors for making connection between electric wires.

Figure 1:
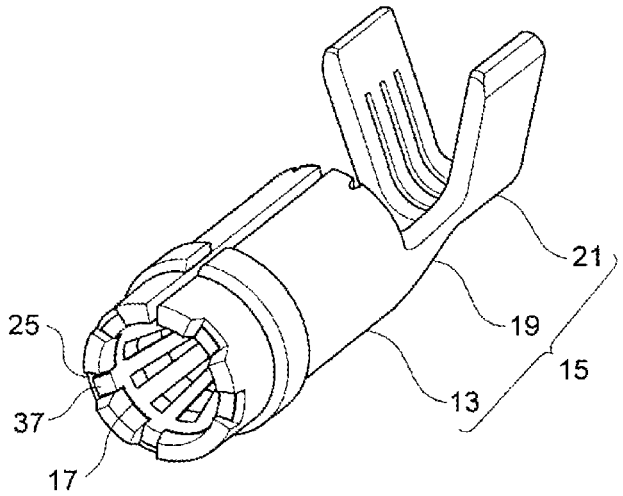
FIG. 1 is a perspective view showing an assembled state of a female terminal to which the invention is applied.

As shown in FIG. 1, a female terminal 11 according to the embodiment includes a conductive terminal body 15 and a cylindrical elastic contact member 17. The terminal body 15 has a cylindrical portion 13 to which a mating rod-like male terminal (not-shown) is inserted. The elastic contact member 17 can apply a predetermined contact pressure to the male terminal inserted into the terminal body 15. Each of the terminal body 15 and the elastic contact member 17 is formed out of a metal flat plate material rounded into a cylindrical shape by pressing. A terminal of an electric wire (not-shown) is to be connected to the female terminal 11. Incidentally, the male terminal side will be regarded as front side in the following description (for example, left side in FIG. 4).

The cylindrical portion 13, a coupling portion 19 and a caulking portion 21 are formed in the terminal body 15 in this order from the front side. The cylindrical portion 13 is formed with an inner diameter slightly smaller than the maximum outer diameter of the cylindrical elastic contact member 17. The axial depth of the cylindrical portion 13 is set to be longer than the total length of the elastic contact member 17 in consideration of the extension of the elastic contact member 17 caused by the insertion of the male terminal as will be described later.

A conductor exposed from a terminal of a not-shown electric wire is connected to the coupling portion 19 by crimping, welding or the like. The caulking portion 21 is folded to envelope an insulating jacket of the terminal of the electric wire so that the electric wire can be crimped and fixed to the terminal body 15.

Figure 2:
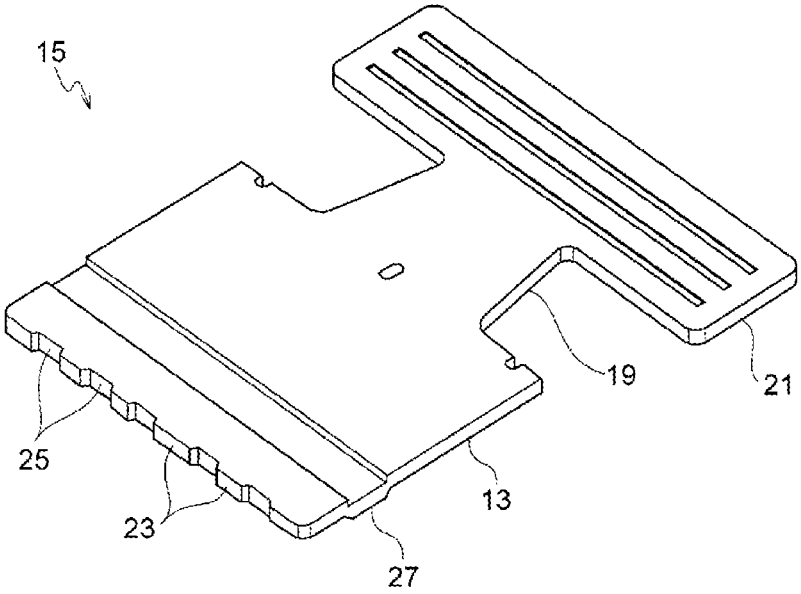
FIG. 2 is a development view of a terminal body of the female terminal to which the invention is applied.

FIG. 2 shows a state in which the terminal body 15 is developed into a flat plate in which the terminal body 15 has not been rounded yet. A plurality of groove portions 25 formed by notching a front end surface 23 of the rectangular cylindrical portion 13 are provided in the terminal body 15 in the width direction thereof and at predetermined intervals. The groove portions 25 have one and the same groove depth. A belt-like convex portion 27 protruding on the outer circumferential surface side is formed in the cylindrical portion 13 along the width direction thereof (the circumferential direction after pressing). The convex portion 27 has a function of positioning the female terminal 11 in a not-shown housing. Opposite side surfaces of the cylindrical portion 13 corresponding to each other in the width direction thereof are disposed so that the side surfaces can face each other when the cylindrical portion 13 is rounded into a cylindrical shape as shown in FIG. 1.

The coupling portion 19 is set to have a width smaller than the width of the cylindrical portion 13, and formed to extend axially as a tapered shape. The caulking portion 21 is set to have a width larger than the width of the cylindrical portion 13.

Figure 3:
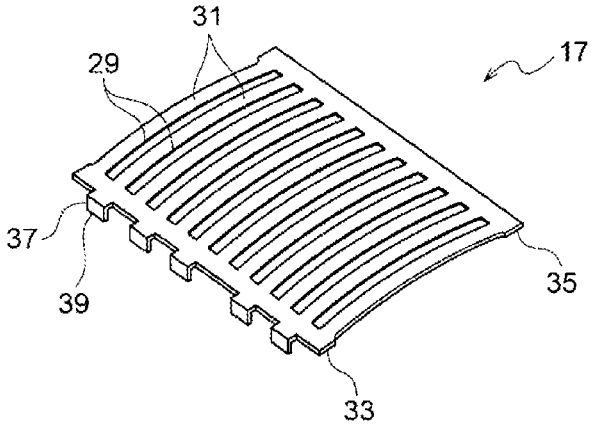
FIG. 3 is a perspective view of an elastic contact member to which the invention is applied.

FIG. 3 shows a state in which the elastic contact member 17 has not been rounded yet but developed. The elastic contact member 17 is formed into a rectangular shape as a whole. In the elastic contact member 17, a plurality of rectangular contact portions 31 partitioned by slits extending in the insertion direction of the male terminal are provided to extend substantially in parallel with the insertion direction of the male terminal. Each contact portion 31 is raised and formed to be curved toward the male terminal, that is, inward (upward in FIG. 3) when the elastic contact member 17 has been rounded. The contact portions 31 are formed so that their opposite ends are connected to one another by a front end portion 33 and a rear end portion 35 extending in the width direction (the circumferential direction when the elastic contact member 17 has been rounded).

The opposite side surfaces of the elastic contact member 17 corresponding to each other in the width direction thereof are disposed so that the side surfaces can face each other when the elastic contact member 17 is rounded into a cylindrical shape. In the elastic contact member 17 rounded into a cylindrical shape, the outer diameters of the front end portion 33 and the rear end portion 35 correspond to the maximum outer diameter of the elastic contact member 17. The longitudinal and lateral dimensions of the elastic contact member 17 developed as in FIG. 3 are set to be smaller than the longitudinal and lateral dimensions of the cylindrical portion 13 of the terminal body 15 developed as in FIG. 2, so that the elastic contact member 17 can be received in the cylindrical portion 13 of the terminal body 15 when they are rounded.

A plurality of plate-like protrusion pieces 37 protruding forward are provided in the front end portion 33. Each protrusion piece 37 is bent at approximately right angles with the front side and formed into an L-shape. As shown in FIG. 1, in the elastic contact member 17 rounded into a cylindrical shape and received in the cylindrical portion 13, a distal end portion 39 of each protrusion piece 37 bent thus is extended radially so that the distal end portion 39 can abut against the groove bottom of corresponding one of the groove portions 25. Here, the groove portion 25 has a groove width slightly larger than the width of the protrusion piece 37 and larger than the thickness of the protrusion piece 37.

Incidentally, the protrusion pieces 37 may be not bent as in the embodiment but provided to protrude perpendicularly from the front end portion 33. In addition, the protrusion pieces 37 may be bent at angles other than the right angles. In this case, in each groove portion 25, an inclined surface corresponding to the bending angle of each protrusion piece 37 is formed in the groove bottom so that the protrusion piece 37 can abut against the groove bottom.

Figure 4:
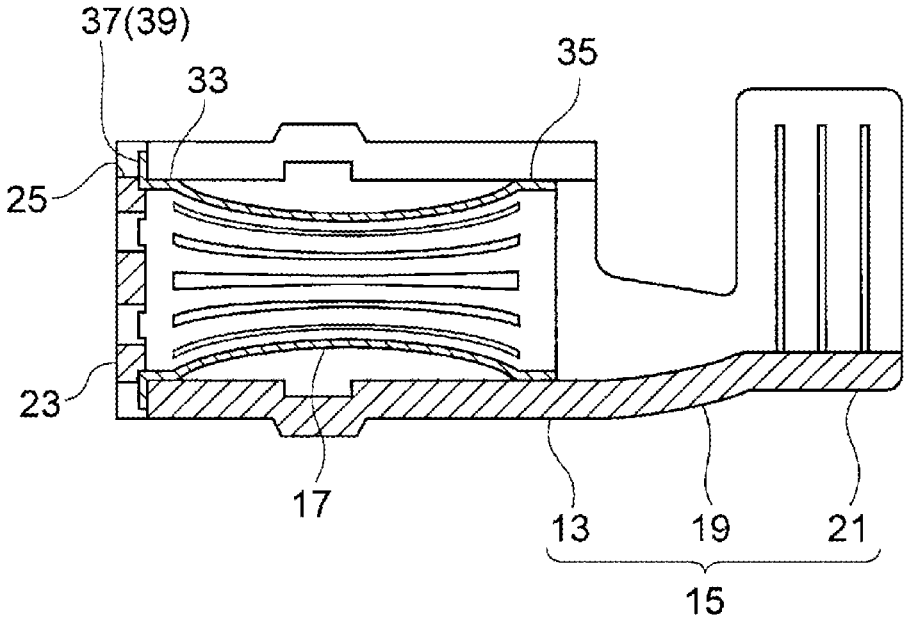
FIG. 4 is a longitudinal sectional view of the female terminal to which the invention is applied.

As shown in FIG. 4, in the elastic contact member 17 received in the cylindrical portion 13, the protrusion pieces 37 (distal end portions 39) of the front end portion 33 are welded with the groove portions 25 respectively, while the rear end portion 35 is a free end. That is, the elastic contact member 17 is fixed to the cylindrical portion 13 only in the front end portion 33 but the rear end portion 35 is so free that the rear end portion 35 can move axially inside the cylindrical portion 13.

When a male terminal is inserted into the cylindrical portion 13 of the female terminal 11 configured thus, each curved contact portion 31 of the elastic contact member 17 is pressed by the male terminal and elastically deformed to expand radially, and the rear end portion 35 serving as a free end is deformed to extend axially. That is, due to increasing elastic deformability, the elastic contact member 17 can be deformed flexibly in accordance with the insertion amount of the male terminal. Accordingly, the elastic contact member 17 can reduce the load with which the male terminal is inserted or removed, while the elastic contact member 17 can secure a sure contact with the male terminal. Incidentally, a stopper for limiting the extension of the rear end portion 35 to a predetermined amount may be provided in the cylindrical portion 13.

In addition, in the elastic contact member 17 according to the embodiment, the front end portion 33 is connected to the cylindrical portion 13 through connection portions (joint portions), which serve as conduction paths between the elastic contact member 17 and the terminal body 15. Thus, reliability in conduction between the elastic contact member 17 and the terminal body 15 can be enhanced.

Further, plating is applied to the cylindrical portion 13 or the elastic contact member 17 for the sake of improvement in conductivity, rust-preventive measures, etc. for each part. Since the elastic contact member 17 is connected to the cylindrical portion 13, large friction can be prevented from occurring between the elastic contact member 17 and the inner circumferential surface of the cylindrical portion 13 even if the male terminal is inserted or removed or even if vibration is transmitted. Thus, separation of the plating can be prevented. According to the embodiment, reliability in conduction between the elastic contact member 17 and the terminal body 15 can be enhanced effectively. It is therefore possible to provide a female terminal suitable for a large current.

In addition, according to the embodiment, the front end portion 33 of the elastic contact member 17 is fixed to the cylindrical portion 13. Thus, a cap for retaining the elastic contact member 17 in the cylindrical portion 13 or a stopper protruding from the inner circumferential surface of the cylindrical portion 13 is no longer required. As a result, the structure becomes easy, and the manufacturing cost can be reduced.

In addition, in the elastic contact member 17 according to the embodiment, the protrusion pieces 39 protruding radially are joined to and put on the front end surface 23 of the cylindrical portion 13 so that their joint portions can be formed at approximately right angles with the insertion direction of the male terminal. Thus, stress applied on the joint portions when the male terminal is inserted can be reduced to prevent damage on the joint portions and prevent separation of the elastic contact member 17.

Next, a method for assembling the female terminal 11 according to the embodiment will be described by way of example. First, the terminal body 15 and the elastic contact member 17 developed into flat plates as in FIGS. 2 and 3 are prepared individually. In the elastic contact member 17, each contact portion 31 is curved, and each protrusion piece 37 is bent into an L-shape.

Figure 5:
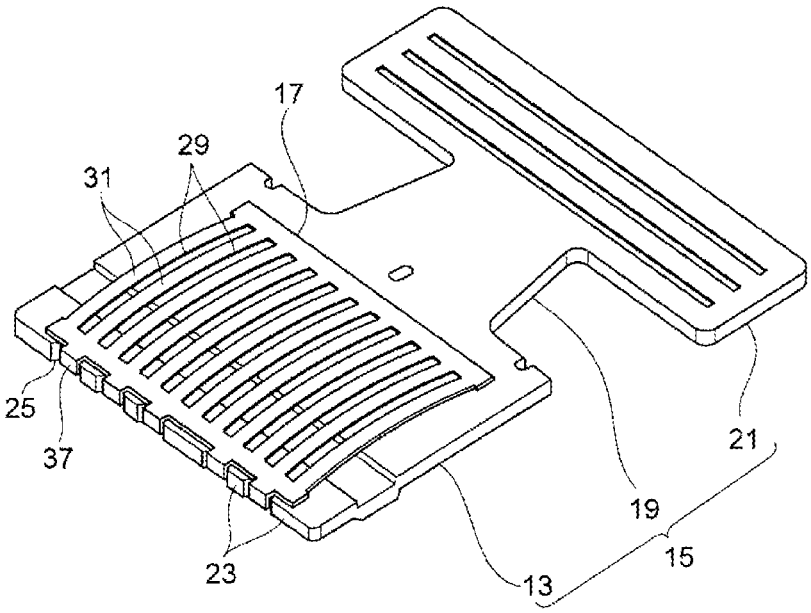
FIG. 5 is a perspective view in which the female terminal in FIG. 1 has not been rounded by pressing yet.

Next, as shown in FIG. 5, the elastic contact member 17 is mounted on the upper surface (serving as an inner circumferential surface) of the terminal body 15. On this occasion, the elastic contact member 17 is disposed so that the protrusion pieces 37 can be located in the groove portions 25 of the terminal body 15 respectively, and the contact portions 31 can be curved on the opposite side to the terminal body 15. Then, the distal end portions 39 of the protrusion pieces 37 are brought into contact with the groove bottoms of the groove portions 25 respectively and welded therewith (for example, by spot welding). Thus, the distal end portions 39 are attached to the groove bottoms.

Next, the cylindrical portion 13 of the terminal body 15 to which the elastic contact member 17 is attached is rounded into a cylindrical shape enveloping the elastic contact member 17 by pressing. That is, the elastic contact member 17 is processed into a cylindrical shape together with the cylindrical portion 13. Thus, the female terminal 11 in which the elastic contact member 17 has been received is formed (FIG. 1).

In the embodiment, the terminal body 15 is rounded in the state where the elastic contact member 17 has been attached to the cylindrical portion 13 of the terminal body 15. It is therefore possible to round the cylindrical portion 13 and the elastic contact member 17 concurrently. Thus, a step of rounding the elastic contact member 17 alone and a press die for the step are no longer required, but the manufacturing cost can be reduced.

In addition, in the embodiment, the protrusion pieces 37 of the elastic contact member 17 are attached to the groove portions 25 located in the front end surface 23 of the cylindrical portion 13. Accordingly, stress applied to the joint portions when the cylindrical portion 13 is rounded can be reduced, for example, in comparison with the case where the protrusion pieces 37 are attached to the inner circumferential surface of the cylindrical portion 13. Thus, separation of the elastic contact member 17 can be prevented surely.

In addition, since the protrusion pieces 37 of the elastic contact member 17 according to the embodiment are located in the groove portions 25 formed in the front end surface 23 of the cylindrical portion 13 respectively, the elastic contact member 17 can be aligned with a predetermined position of the cylindrical portion 13 and welded therewith. Thus, working efficiency in welding can be enhanced. In addition, since the protrusion pieces 37 are received in the groove portions 25 respectively, the protrusion pieces 37 can be prevented from receiving an external force directly. It is therefore possible to protect the joint portion of each protrusion piece 37.

The embodiment of the invention has been described above in detail with reference to the drawings. However, the embodiment is merely an exemplar of the invention. It may be changed or modified within the scope stated in claims.

Figure 6:
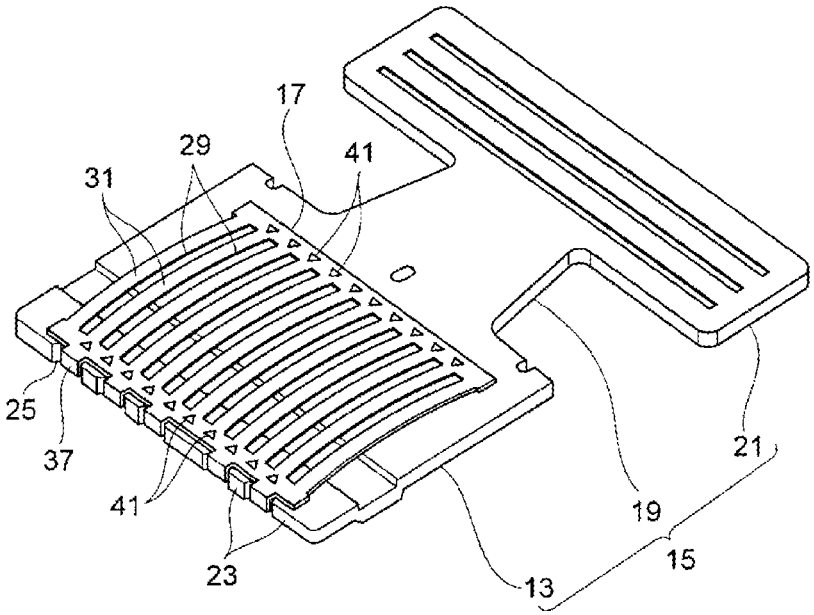
FIG. 6 is a perspective view showing a state in which an elastic contact member according to another embodiment has been installed on the terminal body.

For example, as shown in FIG. 6, a plurality of protrusion portions 41 may be provided in each of the front end portion 33 and the rear end portion 35 of the elastic contact member 17. The protrusion height of each protrusion portion 41 is set at a height lower than the maximum height of each contact portion 31. In this case, the protrusion portions 41 can be brought into circumferential contact with a male terminal inserted into the cylindrical portion 13 so as to support the male terminal at two places on the entrance side and the deeper side. Thus, vibration of the male terminal can be suppressed.

What is claimed is:

1. A female terminal comprising:

a conductive terminal body comprising a cylindrical portion to which a male terminal is to be inserted; and a cylindrical elastic contact member configured to apply a contact pressure to the male terminal which is inserted into the conductive terminal body;

wherein the elastic contact member comprises a plurality of contact portions which are partitioned by slits extending in an insertion direction of the male terminal and the plurality of contact portions are curved toward the male terminal; and wherein a front end portion of the elastic contact member, to which the male terminal is to be inserted, is connected to the conductive terminal body while a rear end portion of the elastic contact member is made a free end;

wherein plating is provided on at least one of the cylindrical portion of the terminal body and the elastic contact member.

2. The female terminal according to claim 1, wherein the front end portion of the elastic contact member is fixed to the cylindrical portion.

3. The female terminal according to claim 1, wherein a plurality of protrusion pieces are protruded radially from the front end portion of the elastic contact member; and wherein the protrusion pieces are connected to a front end surface of the conductive terminal body respectively.

4. The female terminal according to claim 3, wherein the plurality of protrusion pieces are fixed to a front end surface of the cylindrical portion respectively.

5. The female terminal according to claim 3, wherein a plurality of groove portions to which the plurality of protrusion pieces are connected are formed in the front end surface of the conductive terminal body.

* * * * *